US006050014A

United States Patent [19]

Ohlson

[11] Patent Number: 6,050,014

[45] Date of Patent: Apr. 18, 2000

[54] CARD KEEPING ARRANGEMENT

[76] Inventor: Kurt Lennart Ohlson, Ekvägen 8, 186 70, Brottby, Sweden

[21] Appl. No.: 09/180,615

[22] PCT Filed: May 13, 1997

[86] PCT No.: PCT/SE97/00779

§ 371 Date: Nov. 12, 1998

§ 102(e) Date: Nov. 12, 1998

[87] PCT Pub. No.: WO97/42847

PCT Pub. Date: Nov. 20, 1997

[30] Foreign Application Priority Data

May 13, 1996 [SE] Sweden ..... 9601825

[51] Int. Cl.[7] ..... G09F 03/20

[52] U.S. Cl. ..... 40/649; 206/449; 206/37

[58] Field of Search ..... 40/649, 653; 206/37, 206/39, 449, 38

[56] References Cited

U.S. PATENT DOCUMENTS

| | | | |
|---|---|---|---|
| 201,928 | 4/1878 | Lewis | 40/653 X |
| 490,759 | 1/1893 | Tyler | 40/653 |
| 741,091 | 10/1903 | Alger | 40/653 |
| 865,886 | 9/1907 | Guinn | 40/649 |
| 886,843 | 5/1908 | McLellan | 40/653 X |
| 1,877,565 | 9/1932 | Ecker, Jr. | 206/39 |
| 2,185,624 | 1/1940 | Beck | 206/39 |
| 3,029,537 | 4/1962 | Hopp et al. . | |
| 4,356,646 | 11/1982 | Johnson, Jr. | 40/653 X |
| 4,518,080 | 5/1985 | Ohlson | 206/39 |
| 5,125,505 | 6/1992 | Kurosaki | 40/649 X |
| 5,592,767 | 1/1997 | Treske | 40/649 |
| 5,740,624 | 4/1998 | Baseley | 40/649 |

*Primary Examiner*—Joanne Silbermann
*Attorney, Agent, or Firm*—Burns, Doane, Swecker & Mathis, L.L.P.

[57] ABSTRACT

The present invention relates to a card holder arrangement for holding a card that contains specific information and that has specific dimensions. The card holder comprises a rectangular or generally rectangular base plate, raised first side-edges extending along respective long sides of said base plate, raised second side-edges extending along respective short sides of the base plate, a projection on each of the raised first side-edges, said projections extending in over the base plate and towards each other from that edge surface of respective first side-edges which face away from the base plate. The raised second side-edges and the short sides of the base plate include recesses that enable a card placed in said card holder to be gripped on each short side of the card holder, these recesses dividing the raised second side-edges into two laterally related part-edges. The arrangement also includes means for preventing a magnetic strip on a card from becoming worn as a result of inserting and removing the card into and out of the card holder. These means include a beveled surface on respective part-edges that face away from the base plate and slope towards the base plate and towards the recess.

4 Claims, 6 Drawing Sheets

Fig. 1
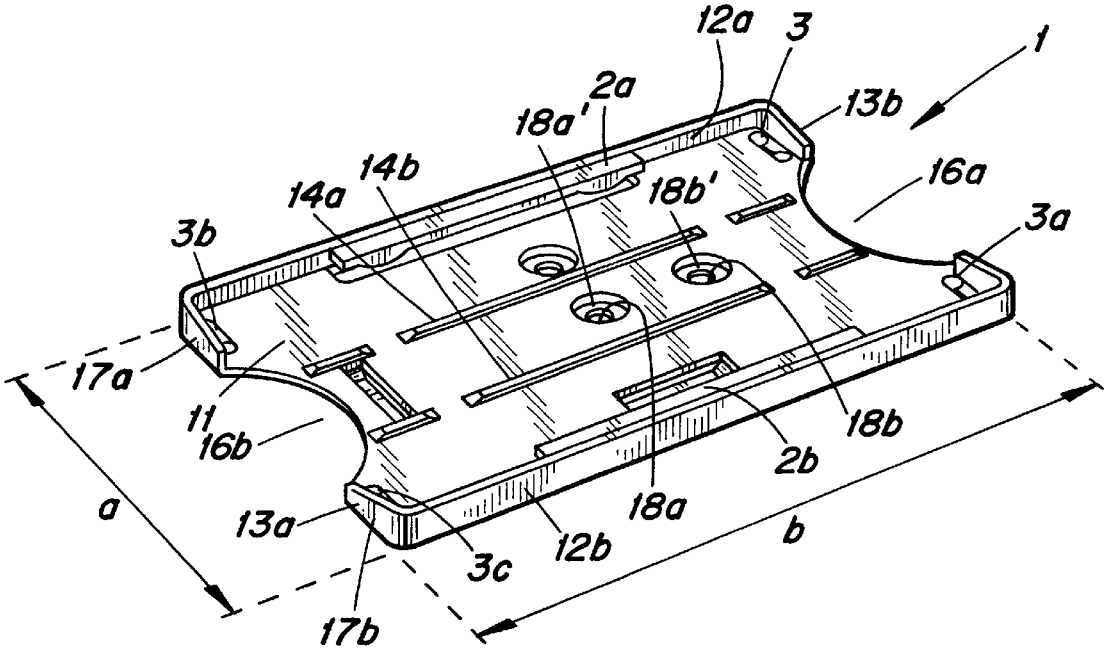
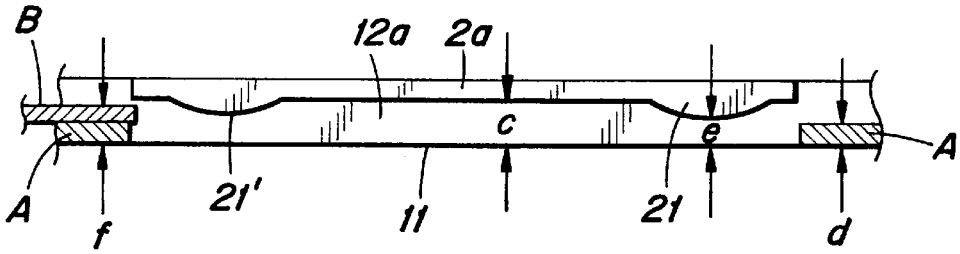
Fig. 2

Fig. 3
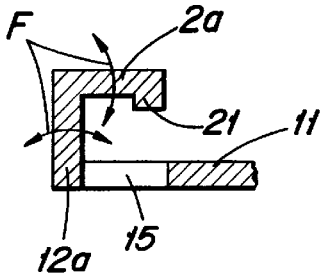
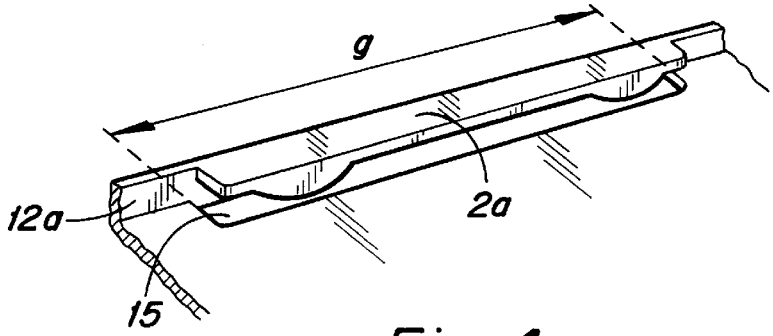
Fig. 4
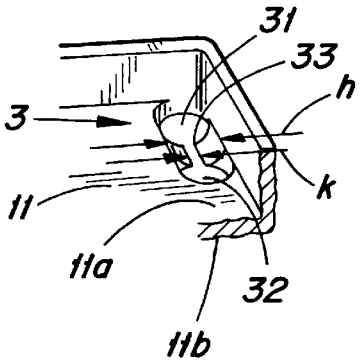
Fig. 5
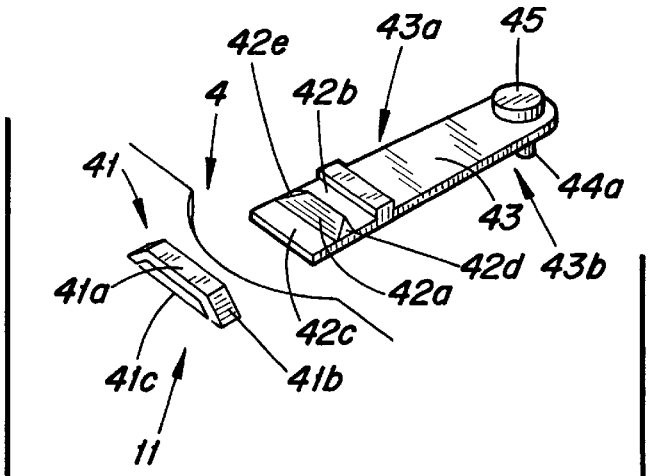
Fig. 6

Fig. 17
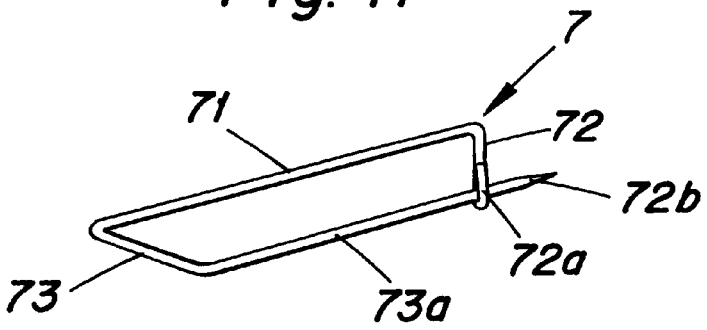
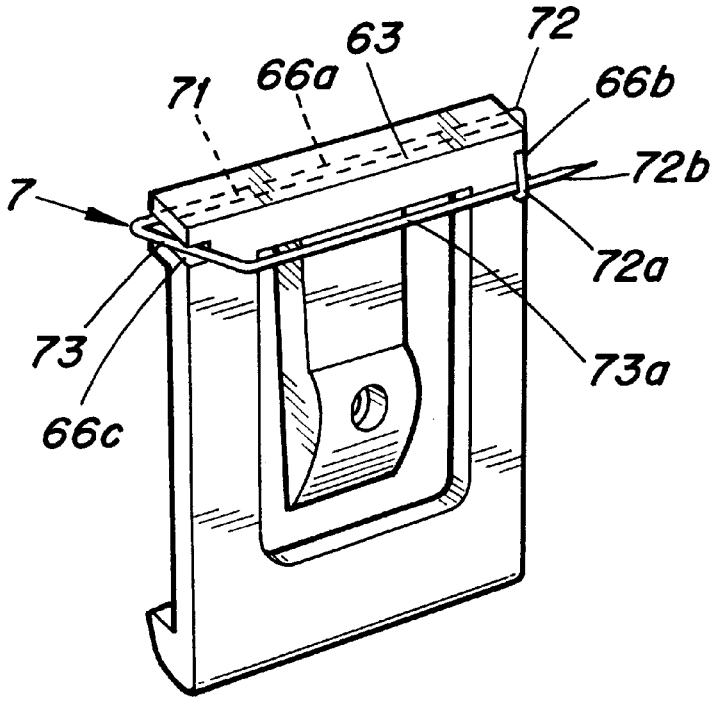
Fig. 18

CARD KEEPING ARRANGEMENT

FIELD OF INVENTION

The present invention relates to a card holder arrangement intended for cards that contain specific information and have specific dimensions.

The arrangement includes a rectangular or generally rectangular base plate, two raised first side-edges that extend up from the base plate, one on each long side of the base plate, two raised second side-edges that extend from the base plate, one along each short side of said base plate, and two projections, one on each of said raised first side-edges.

The projections extend in over said base plate and towards each other from that side surface of respective raised first side-edges that lies distal from the base plate, such as to form a space between the projections and the base plate.

The distance between the inwardly facing surfaces of the raised first side-edges is only slightly greater than the distance between the long sides of the card, and the distance between the inwardly facing surfaces of the raised second side-edges is only slightly greater than the distance between the short sides of said card.

The raised second side-edges and the short sides of said base plate include recesses that enable a card placed in the card holder to be gripped at either end of the holder, said recesses dividing the raised second side-edges into two mutually spaced part-edges that lie on each side of the short sides of the holder.

These side-edges include means for preventing a magnetic tape carried on the card from being worn as a result of being inserted into and removed from the card holder.

The base plate also includes one or more ridges which extend parallel with, or generally parallel with, the raised first side-edges, and which have a length that corresponds to or is slightly shorter than the length of the projections. These ridges function to lift a card held in the holder away from the base plate.

DESCRIPTION OF THE BACKGROUND ART

The use of card holders has long been known in many different contexts. These known card holders are mostly used to carry identification cards within business premises and the like, with the purpose of providing the card holder with access to different locations or to access different pieces of equipment in accordance with the authority carried by the card. The card holder is preferably designed to enable the card to be carried in a simple fashion and to be available to the user in different situations.

A card holder will normally be comprised of a base plate having raised edges within which the card can be neatly accommodated. When the card and the card holder have a rectangular shape, it is known to provide the holder with two mutually opposing edges, generally long side-edges, that coact with projections which extend in over the base plate and towards one another, so as to enable the card to be retained between the side-edges and behind the projections.

It is also known that the magnetic strip of a card is liable to be damaged by wear as a result of moving the card into and out of the card holder if the magnetic strip slides against the raised second side-edges.

The solution of providing respective raised second side-edges with a shoulder-like projection that functions to lift the card away from the second side-edge so that the magnetic strip will have no mechanical contact with the second side-edge when moving the card into and out of the card holder is known to the art.

Because the card holder is used with a product that shall be as cheap as possible, it must be possible to produce a card holder of this kind in a beneficial manner both with respect to its manufacture and from an economical aspect.

SUMMARY OF THE INVENTION

TECHNICAL PROBLEMS

When considering to a card holder arrangement according to the earlier standpoint of techniques as described above that is intended to hold a card that contains specific information and has a specific size and that includes a rectangular or generally rectangular base plate, two raised first side-edges that extend up from the base plate, one along each respective long side of the base plate, two raised second side-edges that extend up from the base plate, one along each short side of said base plate, a projection on each first side-edge, said two projections extending in over the base plate and towards each other from that edge surface of a respective first side-edge which lies distal from the base plate, wherein the distance between the inwardly facing surfaces of the raised first side-edges is only slightly greater than the distance between the long sides of the card and the distance between the inwardly facing surfaces of the raised second side-edges is only slightly greater than the distance between the short sides of the card, wherein the base plate includes one or more ridges that extend parallel, or generally parallel to the raised first side-edges and have a length which is equal to or slightly shorter than the length of the projections, said ridges being intended to lift a card located in the device away from the base plate, and in which card holder the raised second side-edges and the short sides of the base plate include recesses which enable a card placed in the card holder to be gripped at each short side of the card holder, said recesses dividing respective raised second side-edges into two mutually spaced part-edges, it will be seen that a problem resides in how the card holder can be readily provided with means for preventing a magnetic strip mounted on said card from becoming worn as a result of moving the card into and out of the card holder.

Another technical problem resides in realizing the importance of enabling said means to protect a magnetic strip when inserting and withdrawing the card into and out of the card holder and also when actually keeping the card in said holder.

Another technical problem is one of realizing how such means shall be constructed to enable the card holder to be manufactured in a ready and economically advantageous manner.

Another technical problem is one of realizing how such means shall be dimensioned in order to provide a solution to the aforesaid problems.

SOLUTION

With the intention of solving one or more of the aforesaid technical problems, the invention takes as its starting point a card holder for holding a card that contains specific information and that has specific dimensions, said card holder comprising a rectangular or generally rectangular base plate, two raised first side-edges that extend from the base plate, one along each base-plate long-side, two raised second side-edges that extend from the base plate, one along each base-plate short-side, a projection on each of said raised first side-edges, said projections extending over the base plate and towards each other from that edge surface of respective raised first side-edges that lies distal from the base plate.

The distance between the inwardly facing surfaces of the raised first side-edges is only slightly greater than the distance between the long sides of the card, and the distance between the inwardly facing edge surfaces of the raised second side-edges is only slightly greater than the distance between the short sides of said card.

The raised second side-edges and the short sides of the base plate include recesses which enable a card to be gripped on each short side of the holder, said recesses dividing the raised second side-edges into two mutually spaced part-edges on respective sides of said side ends.

The base plate includes one or more ridges which extends or extend parallel, or generally parallel, to the raised first side-edges and which has, or have, a length that corresponds to or is slightly shorter than the length of the projection, said ridges functioning to lift a card away from the base plate of the card holder.

The side-edges include means which prevent the magnetic strip on a card from becoming worn as a result of inserting the card into and removing the card from the card holder.

With the intention of providing the necessary protection for the magnetic strip, the inventive card holder is characterized in that said means have the form of an oblique bevel that extends from that part-edge surface which lies distal from the base plate down towards said base plate and towards said recess.

According to the invention, the bevelled surface will slope at an angle of 5° to 15°, preferably an angle of about 10° in relation to the base plate and said part-edge surface.

When the magnetic strip of a standard card is orientated at a distance of about 4 mm from the long side of the card, it is proposed in accordance with the invention that said bevel shall begin at a point which is located at least 3 mm, preferably from 1 to 2 mm from the inner edge surface belonging to the raised first side-edges.

A card will be held firmly in the card holder between said ridges and said projections. The rigidity of the card and the distance between the projection and base plate enable the magnetic strip to be pressed towards the base plate by the projections.

In accordance with a further embodiment of the invention, the base plate includes at least two further ridges. These further ridges extend parallel, or generally parallel, to the raised first side-edges and are positioned relative to the magnetic strip of a card inserted into the card holder such as to position said strip between one of the two further ridges and the centre of the base plate.

Together with the original ridges on the base plate, these further ridges will ensure that the magnetic strip is be positively lifted free from the base plate.

ADVANTAGES

Those advantages that are primarily afforded by an inventive card holder reside in the possibility of manufacturing a card holder in a ready and economically advantageous manner, while producing a card holder that will not act deleteriously on the magnetic strip of a card as the card is inserted into and removed from the card holder and while keeping the card in said holder.

The main characteristic features of the invention are set forth in the characterizing clause of the following claim 1.

BRIEF DESCRIPTION OF THE DRAWINGS

An inventive card holder will now be described in more detail with reference to exemplifying embodiments thereof and also with reference to the accompanying drawings, in which FIG. 1 is a perspective view of a first side of an inventive card holder;

FIG. 2 is a partially sectioned side view of one side-edge, said side-edge including projections, protrusions and grooves adapted to hold one or two cards;

FIG. 3 is another sectional view of the side-edge shown in FIG. 2, said side-edge including projections, protrusions and grooves;

FIG. 4 is a perspective view of a side-edge provided with projections, protrusions and grooves;

FIG. 5 is a somewhat enlarged perspective view of a through-penetrating channel in the base plate of said card holder;

FIG. 6 is a perspective view of one embodiment of a two-part coupling means for connecting a strip-like element to the base plate;

FIG. 17 is a perspective view of a pin adapted for coaction with a clip; and FIG. 18 is a perspective view of a pin in coaction with a clip.

DETAILED DESCRIPTION OF EMBODIMENTS AT PRESENT PREFERRED

Figure 7:
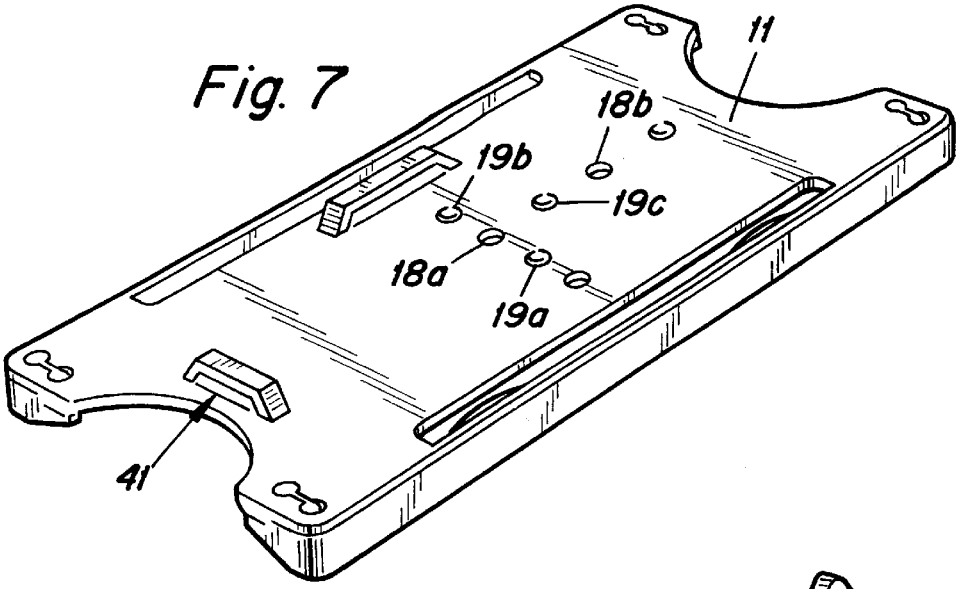
FIG. 7 is a perspective view of the other side of an inventive card holder.

FIG. 1 illustrates a card holder 1 which is intended to hold a card that contains specific information and that has specific dimensions.

The card may have the form of an identity card and the information may comprise data stored in a magnetic strip on the card, a photograph and/or other information that identifies the card carrier and/or establishes certain rights or qualifications with respect to the card carrier. The card may alternatively be a cash card, key card, lift card, or some other type of card.

The card holder includes a rectangular, or generally rectangular, base plate 11, a raised first side-edge 12*a*, 12*b* along each long side of the base plate 11, a raised second side-edge 13*a*, 13*b* along each short side of said base plate 11, and a projection 2*a*, 2*b* on each respective first side-edge 12*a*, 12*b*, said two projections extending in over the base plate and towards each other from that edge surface of its respective first side-edge which lies distal from the base plate.

The distance "a" between the inwardly facing edge surfaces of the raised first side-edges 12*a*, 12*b* slightly exceeds the distance between the long sides of the card, while the distance "b" between the inwardly facing edge surfaces of the raised second side-edges 13*a*, 13*b* only slightly exceed the distance between the short sides of the card, so as to provide space between said side-edges for accommodating a card that is to be kept in the card holder.

The base plate 11 includes one or more ridges 14*a*, 14*b*, two ridges in the FIG. 1 embodiment, which extend parallel to the raised first side-edges 12*a*, 12*b* and which function to lift the card away from the base plate 11. The ridges are positioned on the base plate so as not to come into contact with a possible magnetic strip on a card kept in the card holder.

In the embodiment shown in FIGS. 1 and 2, the projections 2*a*, 2*b* extend only along a part of the first raised side-edges 12*a*, 12*b*, and the distance "c" between the base plate 11 and the projections 2*a*, 2*b* exceeds at least the thickness "d" of a card A, at least at those ends of respective projections that lie proximal to the second raised side-edges.

The ridges 14*a*, 14*b* either have the same length as the projections or are slightly shorter than said projections. This in combination with the distance "c" between the base plate 11 and the projections 2*a*, 2*b* provides a free card-insertion path for insertion of a card A beneath the projections 2*a*, 2*b*.

Each projection 2*a*, 2*b* has at least one tongue-like protrusion 21 that faces towards the base plate 11, where the distance "e" between base plate 11 and protrusion 21 is slightly greater than the thickness "d" of a card A. A card A inserted into the card holder is therewith clamped firmly between the protrusion 21 and the ridges 14*a*, 14*b*.

FIG. 2 shows the projection 2*a* provided with two tongue-like protrusions 21, 21'. It will be understood, however, that a projection may be provided with one, two or more protrusions.

The distance "c" between base plate 11 and a projection 2*a* slightly exceeds the thickness "f" of a card than is thicker than standard or of two cards A, B of standard thickness, therewith allowing a thicker card or two standard cards to be inserted between the base plate 11 and the projection 2*a*.

FIG. 3 is intended to show that the first raised side-edges 12*a*, 12*b* and respective projections 2*a*, 2*b* have a resilient function in relation to the base plate 11, in order to enable two cards A, B to be inserted between the projection 21, 21' and the base plate 11.

As illustrated in FIG. 4, this resilient function F is obtained by providing the base plate 11 with a through-penetrating groove 15 adjacent to and along respective first raised side-edge 12*a*, 12*b*, and by producing the first raised side-edges from a resilient material.

The grooves have a length "g" that corresponds at least to the length of respective projections 2*a*, 2*b*, and are positioned beneath respective projections.

The grooves also have a technical function in manufacture, since they simplify the design of the moulds used to mould an inventive card holder.

The card holder described in the following description is dimensioned to accommodate cards of the standard size often used in the manufacture of identity cards, cash cards, membership cards and like cards, for instance.

When a card of this kind has a thickness of about 0.8 mm, it is proposed that the distance "e" between base plate 11 and protrusion 21 will be from 0.8 to 1.0 mm, preferably about 0.9 mm, and thus slightly greater than the thickness "d" of a card A, so as to enable a card inserted into the card holder 1 to be held firmly between the projections 2*a*, 2*b* and the ridges 14*a*, 14*b*.

The distance "c" between base plate 11 and respective projections 2*a*, 2*b* may be 2.0 to 2.6 mm, and is preferably about 2.3 mm, therewith enabling one or two standard cards A, B or one thicker card to be inserted between the base plate 11 and respective projections 2*a*, 2*b*.

The resilient or "springy" function F can be achieved by producing the first raised side-edges 12*a*, 12*b* from a resilient material, such as polypropylene.

The base plate 11 of the embodiment shown in FIGS. 1 and 5 also includes at least one through-penetrating aperture 3 through which there can be passed a line by means of which the card holder one can be hung on a holder means, such as a hook, or around the neck of the person carrying the card holder.

The aperture 3 is comprised of two through-penetrating holes 31, 32 whose cross-sectional area exceeds the cross-sectional area of the line to be passed through said aperture.

The aperture 3 also includes a slot 33 which interconnects the holes 31, 32 and which has a width smaller than the cross-dimension of the line.

The slot 33 has a first width "h" at the first side 11*a* of the base plate and a second width "k" at the opposite side 11*b* of the base plate, where the first width "h" is greater than the second width "k".

The holes 31, 32 are circular in shape and the first width "h" is equal to the diameter of said hole.

The first width "h" is thus greater than the diameter of the line, whereas the second width "k" is smaller than said diameter.

This enables the line to be threaded through one of the holes and then passed over the slot 33 and back through the next hole 32, and then fastened, e.g. with a knot large enough to prevent the line passing back through the hole 32. This means that the line will lie in the slot 33 but will be unable to pass through said slot, since the second width "k" is smaller than the diameter of said line.

On the other hand, if the card holder is subjected to a sufficiently strong pulling force, the line will be forced through the narrow part "k" of the slot 33, whereupon the line will be drawn away from the card holder 1 without subjecting the wearer to the risk of injury as a result thereof.

It is proposed that the line will have a diameter in the region of 1.4 mm, and that the holes 31, 32 will have a diameter of 1.5 to 2.5 mm, preferably about 2.0 mm, and that the second width "k" will be 0.1 to 0.4 mm, preferably 0.2 to 0.3 mm, such as 0.25 mm.

To enable the card holder 1 to be hung in an "upright" position or in "an incumbent" position, the base plate is provided with four apertures 3, 3*a*, 3*b*, 3*c*, on each respective corner of the base plate 11.

The slot 33 is preferably through-penetrating, although it may also be covered with a thin readily broken covering that determines the force required to insert the line through the slot.

FIG. 6 illustrates another method of carrying the card holder 1. In this embodiment, a second side 11*b* that lies opposite the first side 11*a* of the base plate 11 includes at least one first part 41 of a two-part connector means 4, wherein the second part 42 of said connector means 4 is comprised of a part of a strip-like element that includes a clamping device intended to be fastened to the user's clothing.

The first connector part 41 is comprised of a generally U-shaped projection that includes a web or cross-member 41*a* and two side-members 41*b*.

A first end of the strip-like element 43 includes the second part 42 of the two-part connector 4, said second connector part including a wedge-shaped member 42*a* and a groove 42*b* which extends across the strip-like element adjacent the thicker part of the wedge-shaped member. The width of the groove is adapted so as to accommodate and secure the cross-member of the first connector-part in the groove 42*b*.

The U-shaped projection is formed in the base plate 11. For reasons of a technical nature, the base plate is provided to this end with a through-penetrating aperture 41*c* beneath respective U-shaped projections.

The second connector part 42 also includes an outwardly projecting part 42*c* whose length is equal to or slightly greater than the width of the cross-member 41*a* of the U-shaped projection 41.

The thickness of said thicker part of the wedge-shaped member 42*a* is slightly greater than the distance between that part of the cross-member which lies proximate to the second side of the base plate and the second side of the base plate.

When inserting the first end of the strip-like element 43 beneath the U-shaped projection, the outwardly projecting part 42*c* is first inserted beneath the projection. This outwardly projecting part is thinner than the opening defined by the U-shaped projection and will therefore pass over the through-penetrating aperture 41*c* beneath said projection. The outwardly protruding part 42*c* need not necessarily be inserted at right angles to the opening in the U-shaped projection, and is preferably inserted obliquely into said opening so as to more easily pass over the aperture 41*c*. As the outwardly protruding part 42*c* of the strip-like element exits on the other side of the U-shaped projection, the wedge-shaped member functions to press the U-shaped projection over said wedge-shaped member. Further insertion of the first end of the strip-like element causes the U-shaped projection to snap over the wedge-shaped member 42*a* and down into the groove 42*b*, therewith securing the strip-like element to the base plate 11.

If the outwardly protruding part 42*c* is omitted from the fastener means, there is a danger of the first end of the strip-like element hooking in the aperture 41*c* beneath the U-shaped projection 41 when inserting the first end of the strip-like element beneath the overlying cross-member of the generally U-shaped projection.

The distance between the surface of the cross-member 41*a* that lies proximal to the base plate 11 and the second side 11*b* of the base plate is between 0.7 and 0.9 mm, preferably 0.8 mm.

The outwardly protruding part 42*c* of the strip-like element has a thickness which is only slightly smaller than 0.7 to 0.9 mm, preferably only slightly smaller than 0.8 mm.

The distance between that surface of the cross-member 41*a* which lies distal from the base plate and the second side 11*b* of said base plate is between 1.8 and 2.0 mm, preferably 1.7 mm.

The height of this U-shaped projection 41 enables several card holders to be stacked on top of one another without the U-shaped projection of a first holder obstructing the insertion of a card into a second, rearwardly lying card holder.

The wedge-shaped member 42*a* may have a respective bevel 42*d*, 42*e* on each side of the thickest part of the wedge-shaped member facing the groove 42*b*, so as to facilitate insertion and removal of the wedge-shaped member 42*a* into and out of the first fastener part 41.

FIG. 7 shows the possibility of carrying the card holder in a "standing" or in a "recumbent" position also in the case of this embodiment, by virtue of the fact that the second side 11*b* of the base plate 11 is comprised of two first fastener-parts 41, 41', one fastener-part being centred along the long side of the base plate 11 in the proximity of one long side with the opening in the U-shaped projection facing towards said long side, and one first fastener-part being centred along the short side of the base plate in the proximity of one short side with the opening defined by the U-shaped projection facing towards said short side.

It will be seen from FIG. 6 that a second end 43*b* of the strip-like element, or clasp, includes a first part 44*a* of a second two-part fastener device 44, said first part 44*a* comprising an outwardly projecting part.

Figure 8:
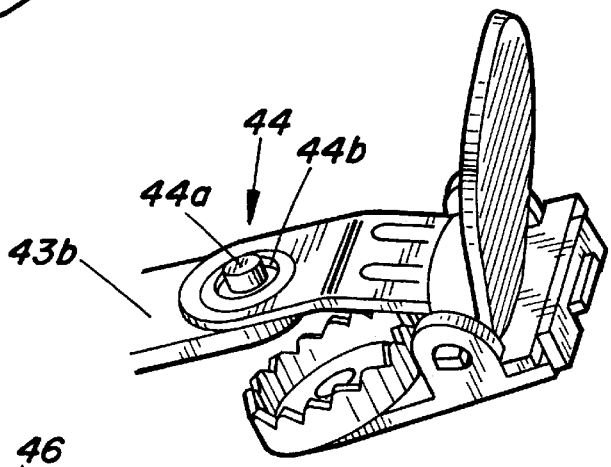
FIG. 8 is a perspective view of a two-part fastener device with which a clamping device can be fastened to a strip-like element.

FIG. 8 illustrates the second end 43*b* of the strip-like element 43 and illustrates an embodiment in which the clamping device has the form of a braces-clip. It will be seen that the clamping device has a through-penetrating hole 44*b*, which forms a second part of the second two-part fastener device 44.

The two parts of the two-part second fastener device 44 are mutually connected by inserting the outwardly projecting part 44*a* through the hole 44*b* and thereafter swaging or likewise deforming the outwardly projecting part. The outwardly projecting part may be deformed either mechanically or by heating the same, such that the cross-sectional area of said part will be greater than the cross-sectional area of the hole and thus affix the clamping device to the strip-like element.

The second end 43*b* of the strip-like element may also include a bulge 45. This bulge may be positioned opposite the outwardly projecting part 44*a* and on the opposite side of the strip-like element 43 to said outwardly projecting part.

Figure 9:
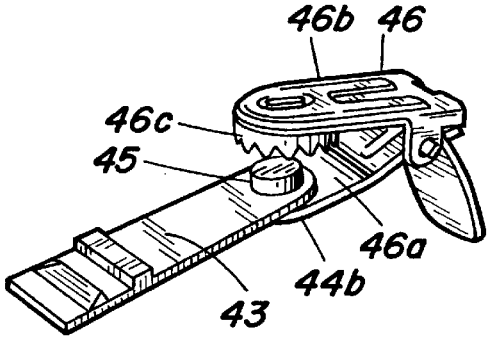
FIG. 9 is a perspective view of an embodiment in which the clamping device has the form of a braces-clip.

The clamping device may be of any suitable kind. FIG. 9 illustrates a preferred embodiment in which the clamping device has the form of a braces-clip 46, wherewith one jaw 46*a* of the clip is provided with the aforesaid hole 44*b* and the other jaw 46*b* has a toothed ring-shaped element 46*c*. The bulge 45 is located in the vicinity of the point at which the clamping device is connected to the strip-like element 43 and functions as an anvil surface for coaction with the toothed element 46*c* when the braces-clip is clipped onto the clothing of the carrier, for instance.

Figure 10:
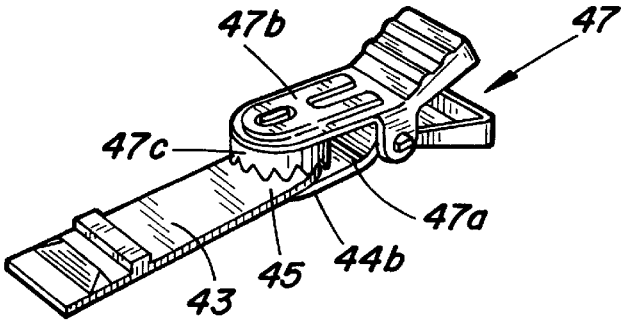
FIG. 10 is a perspective view of an embodiment in which the clamping device has the form of a crocodile clip.

FIG. 10 illustrates an alternative embodiment, in which the clamping device has the form of a crocodile clip 47, where one jaw 47*a* of the clip is provided with said hole 44*b* and the other jaw 47*b* is also provided with a clamping part, e.g. a serrated part 47*c*, wherewith the bulge 45 located in the proximity of the connection of the clamping device to the strip-like element 43 and functions as an anvil or counter-pressure means against the serrated part 47*c* when clipping the crocodile clip onto the clothing of the person carrying the card, for instance.

As will be understood, the strip-like element 42 may include some other type of means for fastening it to an article of clothing, such as some type of safety pin or a touch-and-close fastener.

Figure 11:
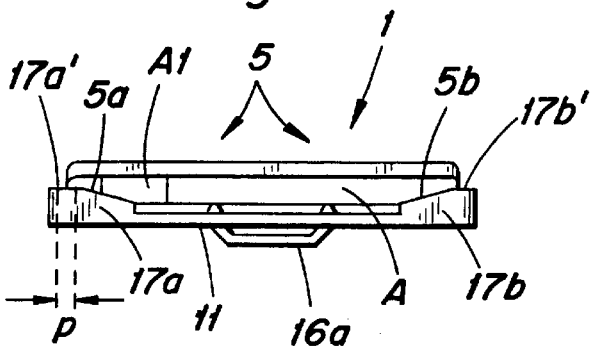
FIG. 11 is a side view of means for protecting the magnetic strip on a card upon insertion and removal of the card into and out of the card holder.

It will be evident from FIG. 1 and also from FIG. 11 that the short sides of the base plate 11 include recesses 16*a*, 16*b* that enable a card A placed in the card holder 1 to be gripped at each short side thereof. Respective second raised side-edges 13*a*, 13*b* are hereby divided into two laterally separated part-edges 17*a*, 17*b*.

The card holder 1 includes means 5 for preventing the magnetic strip A1 on the card A from becoming worn as a result of inserting and removing the card A into and out of the card holder 1.

These means 5 include a bevelled surfaces 5*a*, 5*b*, which extend towards the base plate 11 and towards the recess 16*a* from that edge surface 17*a*', 17*b*' of respective part-edges 17*a*', 17*b*' that faces away from the base plate 11.

As a card A is inserted into or withdrawn from the card holder 1, the card will slide against the laterally located part-edges 17*a*, 17*b*, and more specifically against that part 17*a*', 17*b*' of respective part-edges that is not bevelled.

The bevelled surface 5*a*, 5*b* is inclined at an angle of from 5° to 15°, preferably about 10°, to the base plate 11 and to the edge surfaces 17*a*', 17*b*'.

The magnetic strip A1 of a standard card A is located about 4 mm from one long side of the card.

In order to prevent a magnetic strip A1 on the card A from being damaged or impaired as the card is inserted into and/or removed from the card holder 1, each bevelled surface commences at a point which is located at a distance "p" from the inner edge surface of the first raised side-edges 12*a*, 12*b*, said distance being at most 3 mm, preferably from 1 to 2 mm.

Figure 12:
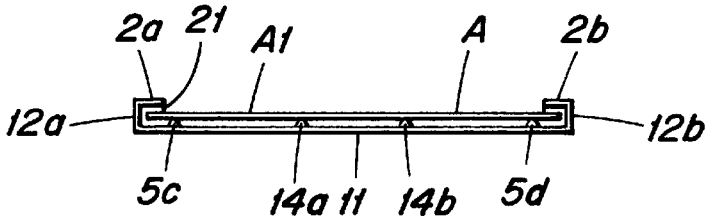
FIG. 12 is a side view of part of an inventive card holder provided with further means for protecting the magnetic strip on a card upon insertion and removal of the card into and out of the card holder.

As evident from FIG. 12, said means may also include at least two further ridges 5*c*, 5*d* on the base plate 11. These further ridges extend parallel to, or generally parallel to, the first raised side-edges 12*a*, 12*b* and are positioned relative to a magnetic strip A1 on a card A inserted into the card holder such that said magnetic strip will be positioned between one, 5*c*, of said further ridges and the centre of the base plate 11.

Since the original ridges 14*a*, 14*b* are located on either side of the centre of the base plate, any magnetic strip that may be present on a card which is inserted into the card holder will be located between one of the original ridges 14*a*, 14*b* and one of the further ridges 5*c*, 5*d*. This excludes the risk of the magnetic strip being pressed down against the base plate 11 by a user of the card holder or by the projections 2*a*, 2*b* that possibly include tongue-like protrusions 21.

Figure 13:
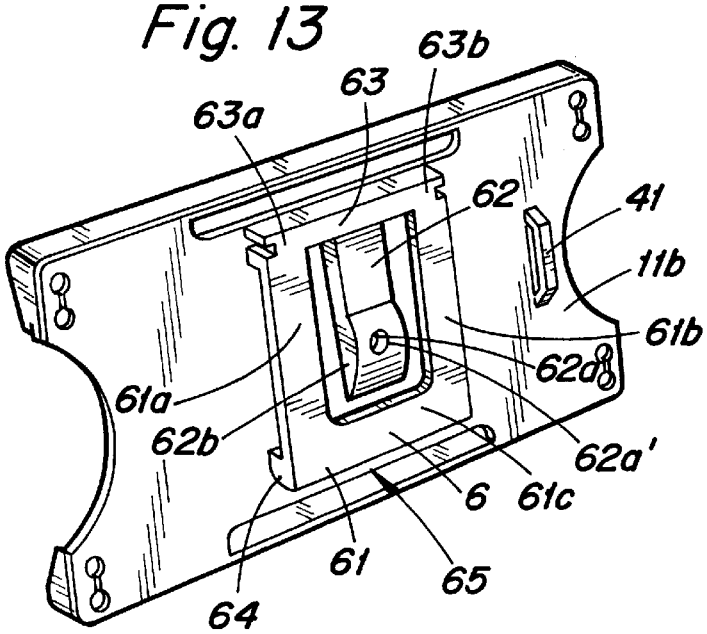
FIG. 13 is a perspective view of a base-plate mounted clip.

As will be seen from FIG. 13, the other side 11*b* of the base plate is provided with a clip 6 by means of which the base plate can be fastened to the wearer's clothing, such as to a pocket or a lapel. The clip includes two resilient arms 61, 62 that can be swung away from one another, and a part 63 which interconnects said arms.

The first resilient arm 61 is comprised of two legs 61*a*, 61*b* and a leg-interconnecting part 61*c*, wherein said legs extend from a respective first end 63*a* and second end 63*b* of the interconnecting part 63, with the interconnecting part in the second end of the legs.

The interconnecting part 61*c* includes a shoulder-like projection 64 which is intended to lie proximal to the second side 11*b* of the base plate 11 when mounting the clip on said base plate.

The second resilient arm 62 extends from the centre of the arm-interconnecting part 63, between the legs 61*a*, 61*b* and towards the leg-interconnecting part 61*c*.

The second resilient arm 62 functions to fasten the clip 6 to said second side 11*b* of the base plate. The device is fastened to an item of the user's clothing by inserting a piece of said clothing into an opening 65 that can be provided between the first and the second resilient arms.

The clip is pivotally or rotatably connected to said second side 11*b* of the base plate, e.g. riveted thereto.

As will be seen from FIGS. 1 and 7, the base plate 11 includes one or more through-penetrating, holes 18*a*, 18*b* that accommodate rivet-pins and therewith enable the clip to be riveted to said second side 11*b* of the base plate. The hole or holes is/are countersunk as at 18*a*', 18*b*' on the first side 11*a* of the base plate, so as to enable the protruding part of the rivet pin or pins to be beaten down into its countersink on the first side of said base plate.

The second resilient arm 62 includes a through-penetrating hole 62*a* having a countersink 62*a*' around said hole to enable the protruding part of the rivet pin to be beaten down into its countersink in the second resilient arm 62.

The clip also includes a device for gripping engagement with an article of clothing, as described in more detail hereinafter.

The end of the second arm 62 distal from the interconnecting part 63 has a thickening 62*b* which faces away from the base plate 11, and the through-penetrating countersunk hole 62*a* for riveting in the second resilient arm is positioned in relation to said thickening 62*b* such as to provide room for effecting said countersink 62*a*' in the thickening 62*b*. The thickening 62*b* is adapted to project slightly upwards between the legs 61*a*, 61*b* of the first arm 61.

The base plate has two through-penetrating, rivet-pin accommodating holes 18*a*, 18*b* for effecting said riveting operation. A first hole 18*a* is positioned centrally in relation to the base plate 11 and is intended for use in fastening a clip 6 when positioning a rotatable or pivotable clip centrally on the base plate.?

A second hole 18*b* is positioned centrally between the raised first side-edges of the base plate and is offset slightly in relation to the raised second side-edges of said base plate and is intended for use in connection with a clip that is rotated solely to one position in which the opening faces towards a short side of the base plate.

Figure 14:
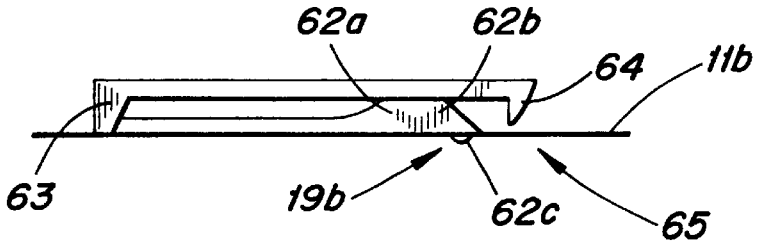
FIG. 14 shows a clip in side view.

It will be seen from FIG. 14 that the second resilient arm 62 includes a wart-like protrusion 62*c* which faces towards said second side 11*b* of the base plate 11, said wart-like protrusion 62*c* being positioned adjacent the through-penetrating hole 62*a* and facing away from the interconnecting part 63 relative to the hole 62*a*.

The second side 11*b* of the base plate 11 includes one or more cavities 19*a*, 19*b*, 19*c* adjacent respective holes 18*a*, 18*b*, and the distance between the wart-like protrusion 62*c* and its adjacent hole 62*a*, and the distance between respective cavities 19*a*, 19*b*, 19*c* and their adjacent holes 18*a*, 18*b* is adapted to enable coaction between the wart-like protrusion 62*c* and a cavity 19*a* when turning the clip 6 relative to the base plate 11, so as to enable the clip to be fixed in given positions relative to the base plate.

The extent to which the second hole 18*b* is offset is adapted to enable the clip 6 to be mounted in a manner that only a small part of a card kept in the card holder, i.e. a part sufficient to provide said gripping surface 16*a*, will extend beyond the edge of that part of an article of clothing to which the card holder is attached, such as a lapel or a pocket.

Figure 15:
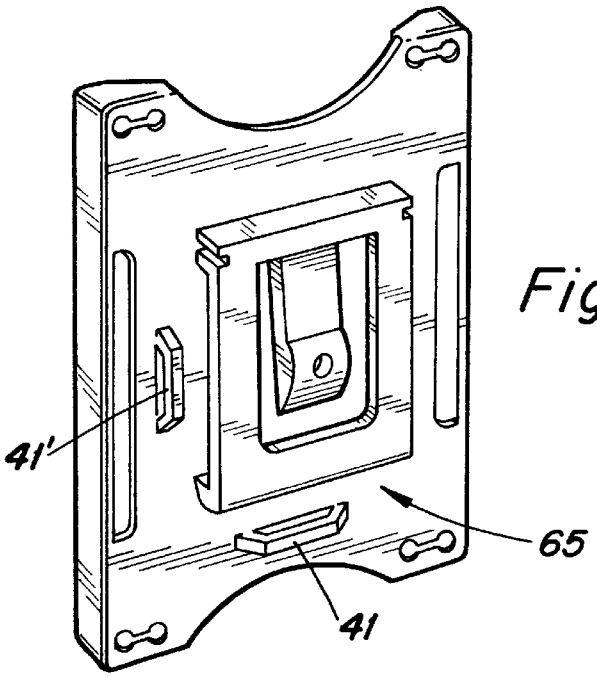
FIG. 15 shows the clip of FIG. 13 rotated to an alternative position.

As earlier described, the generally U-shaped projections 41, 41' are positioned such that a first projection 41 will be located immediately outside the opening 65 in a first position of the clip relative to the base plate, in accordance with FIG. 15, and that a second projection 41 will be positioned immediately outside the opening 65 in a second position of the clip 6 relative to the base plate 11, in accordance with FIGS. 13 and 14.

The earlier mentioned gripping member is comprised of said shoulder-like protrusion 64, the thickening 62*b*, and a projection 41 located outside the opening, in accordance with FIG. 14, which in gripping a piece of clothing together grip around a piece of clothing inserted between the first and the second resilient arms.

The thickening 62*b* is adapted to project up between the two legs 61*a*, 61*b* of the first arm 61, thereby further enhancing the gripping effect of the device on a piece of clothing.

The present invention also enables the clip to be adapted for coaction with a needle or pin intended to be fastened to a card-carrier's clothing.

Figure 16:
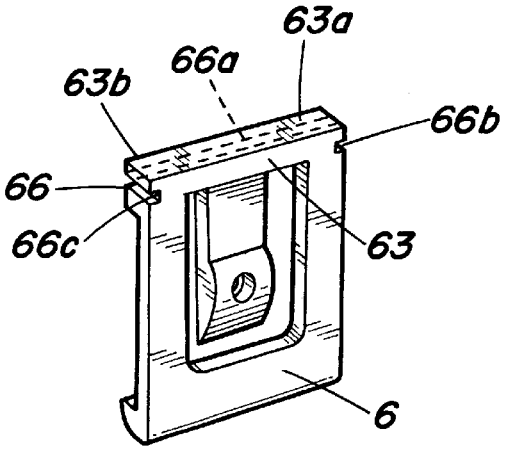
FIG. 16 is a perspective view of a clip adapted for coaction with a pin.

As illustrated in FIG. 16, the gripping device can be adapted in this regard by providing the interconnecting part 63 with a groove 66 that comprises at least two part-grooves 66*a*, 66*b*, i.e. a first part-groove 66*a* that extends from the first end 63*a* of the interconnecting part 63 to the second end 63*b* of said interconnecting part, said first part-groove facing towards the second side 56 of that side which faces towards the base plate, and a second part-groove 66*b* which leads away from said second side 12*b* of the base plate 11 at the first or the second end 63*a*, 63*b* of the interconnecting part 63 and to that side of the interconnecting part 63 which faces away from the second side 11*b* of the base plate 11.

FIG. 17 is intended to illustrated a pin or clasp 7 for coaction with such a groove 66, said pin including a two-ended main-part 71, and a first part 72 and a second part 73 extending from respective ends of said main part 71. The first and the second part 72, 73 are bent so as to mutually converge, generally in a common plane. The first part 72 is terminated with a hook 72*a*, and the second part 73 is terminated with a needle-like portion 72*b* which is bent towards and insertable into the hooked portion 72*a*.

As will be evident from FIG. 18, the pin 7 is dimensioned so that the length of the main part 71 will exceed the length of the interconnecting part 63, and that the first and second parts 72, 73 mutually converge so that one, 72, of said parts will converge into the second part-groove 66*b* when the pin 7 is fitted to the clip 6, with the main part 71 positioned in the first part-groove 66*a*.

The clip 6 may alternatively be provided with a third part-groove 66*c* that will enable both the first and the second part 72, 73 of the pin to be locked in a part-groove when fitting the pin to the clip, as illustrated in FIG. 18.

It is proposed in accordance with the invention that the clip 6 is made of a resilient material, such as polyacetal, so as to ensure that the clip will retain its resiliency over a long period of time, even in a stressed state.

The present invention is complementary to those inventions that are more clearly illustrated and described in corresponding patent applications filed on the same day as this application and relating to card holders, card holder units, card holder arrangements, and arrangements relating to card holders, the subject matter of these applications constituting a part of the description of the present invention.

It will be understood that the invention is not restricted to the aforedescribed and illustrated exemplifying embodiments thereof and that modifications and changes can be made within the scope of the inventive concept as defined in the following claims.

I claim:

1. A card holder for holding a card that contains specific information and that has specific dimensions, said card holder comprising a rectangular or generally rectangular base plate, a raised first side-edge along each long side of said base plate, a raised second side-edge along each short side of said base plate, a projection on each of said raised first side-edges, said projections extending in over the base plate and towards each other from that edge surface of the first side-edge which faces away from the base plate, the distance between the inwardly facing edge surfaces of said raised first side-edges only slightly exceeding the distance between the long sides of said card, and the distance between the inwardly facing edge surfaces of said raised second side-edges only slightly exceeding the distance between the short sides of said card, said projections extending solely along a part of said raised first side-edges, and said base plate including one or more ridges which extends/extend parallel or essentially parallel to said raised first side-edges and has/have a length equal to or slightly shorter than the length of said projections, said ridges functioning to lift a card placed in the card holder away from said base plate, wherewith said raised second side-edges and said short sides of the base plate include recesses that enable a card placed in said card holder to be gripped on each short side of the card holder, said recesses dividing the raised second side-edges into two laterally related part-edges, and wherewith said card holder includes means for preventing a magnetic strip on said card from becoming worn as a result of inserting and removing the card into and out of the card holder, characterized in that said means includes a bevelled surface on respective part-edges that face away from the base plate and slope towards said base plate and towards said recess.

2. A card holder according to claim 1, characterized in that said bevelled surface slopes relative to said base plate and said edge at an angle of from 5° to 15°, preferably about 10°.

3. A card holder according to claim 1, characterized in that said bevelled surface commences at a point located at most 3 mm, preferably 0 to 2 mm from the inwardly facing surfaces of respective raised first side-edges.

4. A card holder according to claim 1, characterized in that said means further includes at least two additional ridges on said base plate; in that said additional ridges extend parallel, or generally parallel, to said raised first side-edges; and in that said additional ridges are so positioned that a magnetic strip on a card inserted into said card holder will be located between one of said additional ridges and the centre of said base plate.

* * * * *